US008011203B1

(12) United States Patent
Schenk et al.

(10) Patent No.: US 8,011,203 B1
(45) Date of Patent: Sep. 6, 2011

(54) REFRIGERATION APPLIANCE WITH HIDDEN USER INTERFACE

(75) Inventors: Dennis Schenk, Anderson, SC (US); Cory Dale Simpson, Abbeville, SC (US); Nilton Carlos Bertolini, Anderson, SC (US)

(73) Assignee: Electrolux Home Products, Inc., Cleveland, OH (US)

( * ) Notice: Subject to any disclaimer, the term of this patent is extended or adjusted under 35 U.S.C. 154(b) by 0 days.

(21) Appl. No.: 12/713,790

(22) Filed: Feb. 26, 2010

(51) Int. Cl.
*F25D 3/00* (2006.01)

(52) U.S. Cl. ..... 62/389; 62/441

(58) Field of Classification Search ..... 62/441, 62/132, 440, 389, 449, 127, 298, 264; 222/146.6; 96/224; 55/318, 385.1; 312/401, 228
See application file for complete search history.

(56) References Cited

U.S. PATENT DOCUMENTS

| | | | | |
|---|---|---|---|---|
| 4,014,178 | A * | 3/1977 | Kells | 62/3.6 |
| 4,441,002 | A * | 4/1984 | Teich et al. | 219/708 |
| 4,966,004 | A | 10/1990 | Midlang et al. | |
| 5,365,959 | A | 11/1994 | Favaro | |
| 5,419,148 | A * | 5/1995 | Kuehl et al. | 62/208 |
| 5,896,915 | A * | 4/1999 | Westbrooks et al. | 165/11.1 |
| 5,921,095 | A * | 7/1999 | Lee et al. | 62/175 |
| 6,134,906 | A * | 10/2000 | Eastman | 62/331 |
| 6,405,544 | B2 * | 6/2002 | Hiraoka et al. | 62/127 |
| 6,483,695 | B1 * | 11/2002 | Hartstein | 361/679.09 |
| 6,598,611 | B1 | 7/2003 | Durazzani | |
| 6,719,383 | B2 | 4/2004 | Elick et al. | |
| 7,032,391 | B2 * | 4/2006 | Tremblay et al. | 62/68 |
| 7,201,175 | B2 * | 4/2007 | DeBoer et al. | 134/57 D |
| 7,493,774 | B2 * | 2/2009 | Ferragut et al. | 62/177 |
| 7,568,358 | B2 | 8/2009 | Wetekamp | |
| 7,765,819 | B2 * | 8/2010 | Anell et al. | 62/186 |
| 2005/0268623 | A1 * | 12/2005 | Urakubo et al. | 62/78 |
| 2006/0087207 | A1 * | 4/2006 | Oh et al. | 312/402 |
| 2006/0196214 | A1 | 9/2006 | Lee et al. | |
| 2006/0260341 | A1 | 11/2006 | Meyvis et al. | |
| 2007/0159454 | A1 | 7/2007 | Rodriguez et al. | |
| 2007/0194675 | A1 | 8/2007 | Van Beek et al. | |
| 2007/0268682 | A1 | 11/2007 | Kim et al. | |
| 2008/0202147 | A1 * | 8/2008 | Lim et al. | 62/389 |
| 2009/0284157 | A1 * | 11/2009 | Wetekamp | 315/154 |
| 2010/0071401 | A1 * | 3/2010 | Jang et al. | 62/391 |
| 2010/0168920 | A1 * | 7/2010 | Hooker et al. | 700/275 |
| 2010/0217441 | A1 * | 8/2010 | Eichman | 700/275 |

FOREIGN PATENT DOCUMENTS

| | | |
|---|---|---|
| JP | 2004116788 | 4/2004 |

* cited by examiner

*Primary Examiner* — Mohammad Ali
(74) *Attorney, Agent, or Firm* — Pearne & Gordon LLP

(57) ABSTRACT

Provided is a refrigeration appliance including a cabinet defining a fresh-food compartment and a freezer compartment. The refrigeration appliance includes a refrigeration system that is operable to provide a cooling effect to an interior of the fresh-food and freezer compartments. A pair of doors is pivotally connected to the cabinet with a hinge assembly for restricting access to the interior of the fresh-food compartment. Each door includes a side portion extending between an exterior face and an interior portion of the door. The side portions of the doors generally oppose each other when the doors are closed. A user interface is also provided to the side portion of at least one of the doors comprising an input device to be manipulated by a user for controlling a target temperature within at least one of the fresh-food and freezer compartments.

19 Claims, 5 Drawing Sheets

REFRIGERATION APPLIANCE WITH HIDDEN USER INTERFACE

BACKGROUND OF THE INVENTION

1. Field of the Invention

The present invention is directed generally to a refrigeration appliance and, more particularly, to a refrigeration appliance including a user interface provided to a side portion of a door restricting access to a temperature-controlled compartment of the refrigeration appliance.

2. Description of Related Art

Refrigeration appliances have conventionally included at least one temperature-controlled compartment in which food items can be stored at temperatures below room temperature. A user interface has also traditionally been provided within the temperature-controlled compartment to allow a user to select the desired target temperature for that temperature-controlled compartment. However, placing the user interface within the temperature-controlled compartment consumed usable space therein. Further, such user interfaces were typically located near the top of the temperature-controlled compartment, making it difficult for short users to reach the user interface.

More recently, a user interface has been provided to an exterior face of the door. However, user interfaces at this location have traditionally been limited to controlling operation of an ice dispenser provided to the refrigeration appliance. Users are unable to input commands for controlling the cooling effect provided to the interior of the temperature-controlled compartment. Further, placing the user interface for controlling the cooling effect provided by the refrigeration appliance or any other aspect of the refrigeration appliance on an exterior face of the door would provide the refrigeration appliance with an unsightly appearance.

BRIEF SUMMARY OF THE INVENTION

Accordingly, there is a need in the art for a refrigeration appliance including a readily-accessible user interface and a location that does not detract from a clean, simple appearance. The following summary presents a simplified summary in order to provide a basic understanding of some aspects of such a refrigeration appliance. This summary is not an extensive overview of the systems and/or methods discussed herein. It is not intended to identify key/critical elements or to delineate the scope of such systems and/or methods. Its sole purpose is to present some concepts in a simplified form as a prelude to the more detailed description that is presented later.

According to one aspect, the present invention provides a refrigeration appliance including a cabinet defining a fresh-food compartment for storing food items in a temperature-controlled environment having a fresh-food target temperature above 0° C. and a freezer compartment for storing food items in a temperature-controlled environment having a freezer target temperature that is less than or approximately equal to 0° C. The refrigeration appliance also includes a refrigeration system that is operable to provide a cooling effect to an interior of the fresh-food and freezer compartments. A pair of doors is pivotally connected to the cabinet with a hinge assembly for restricting access to the interior of the fresh-food compartment. Each door includes an exterior face that is exposed to an ambient environment of the refrigeration appliance, an interior portion that is exposed to an interior of the compartment while the door is closed, and a side portion extending between the exterior face and the interior portion of the door. The side portions of the doors generally oppose each other when the doors are closed. A user interface is also provided to the side portion of at least one of the doors comprising an input device to be manipulated by a user for controlling a target temperature within at least one of the fresh-food and freezer compartments.

According to another aspect, the present invention provides a refrigeration appliance including a cabinet defining a fresh-food compartment for storing food items in a temperature-controlled environment having a fresh-food target temperature above 0° C., and a freezer compartment disposed at an elevation vertically beneath the fresh-food compartment for storing food items in a temperature-controlled environment having a freezer target temperature that is less than or approximately equal to 0° C. A refrigeration system is operable to provide a cooling effect to an interior of the fresh-food and freezer compartments. A freezer drawer can be slideably extracted from the freezer compartment to grant access to contents within the freezer drawer. A first door is pivotally connected adjacent to a first lateral side to the cabinet with a hinge assembly to restrict access to a portion of the fresh-food compartment. Likewise, a second door is pivotally connected adjacent to a second lateral side to the cabinet with a hinge assembly to restrict access to another portion of the fresh-food compartment. The first and second doors each include a substantially-planar side portion that includes a face that opposes the face of the other of the first and second doors when the first and second doors are closed. A user interface that is at least partially recessed within the side portion of at least one of the first and second doors, wherein the user interface is substantially flush with the side portion such that the user interface is substantially hidden from view when the doors are closed. The user interface includes an input device to be manipulated by a user for controlling a temperature within at least one of the fresh-food and freezer compartments, a display device indicating a sensed temperature within the at least one of the fresh-food and freezer compartments, and a status indicator indicating a status of at least one of: a water filter provided to the refrigeration appliance, an air filter provided to the refrigeration appliance, and an operational state of the refrigeration system. Cooperating mullion seal portions are provided to the first and second doors adjacent to the side portions that cooperate to form a seal between the first and second doors are closed.

BRIEF DESCRIPTION OF THE DRAWINGS

The invention may take physical form in certain parts and arrangement of parts, embodiments of which will be described in detail in this specification and illustrated in the accompanying drawings which form a part hereof and wherein.

DETAILED DESCRIPTION OF ILLUSTRATIVE EMBODIMENTS

Figure 1A:
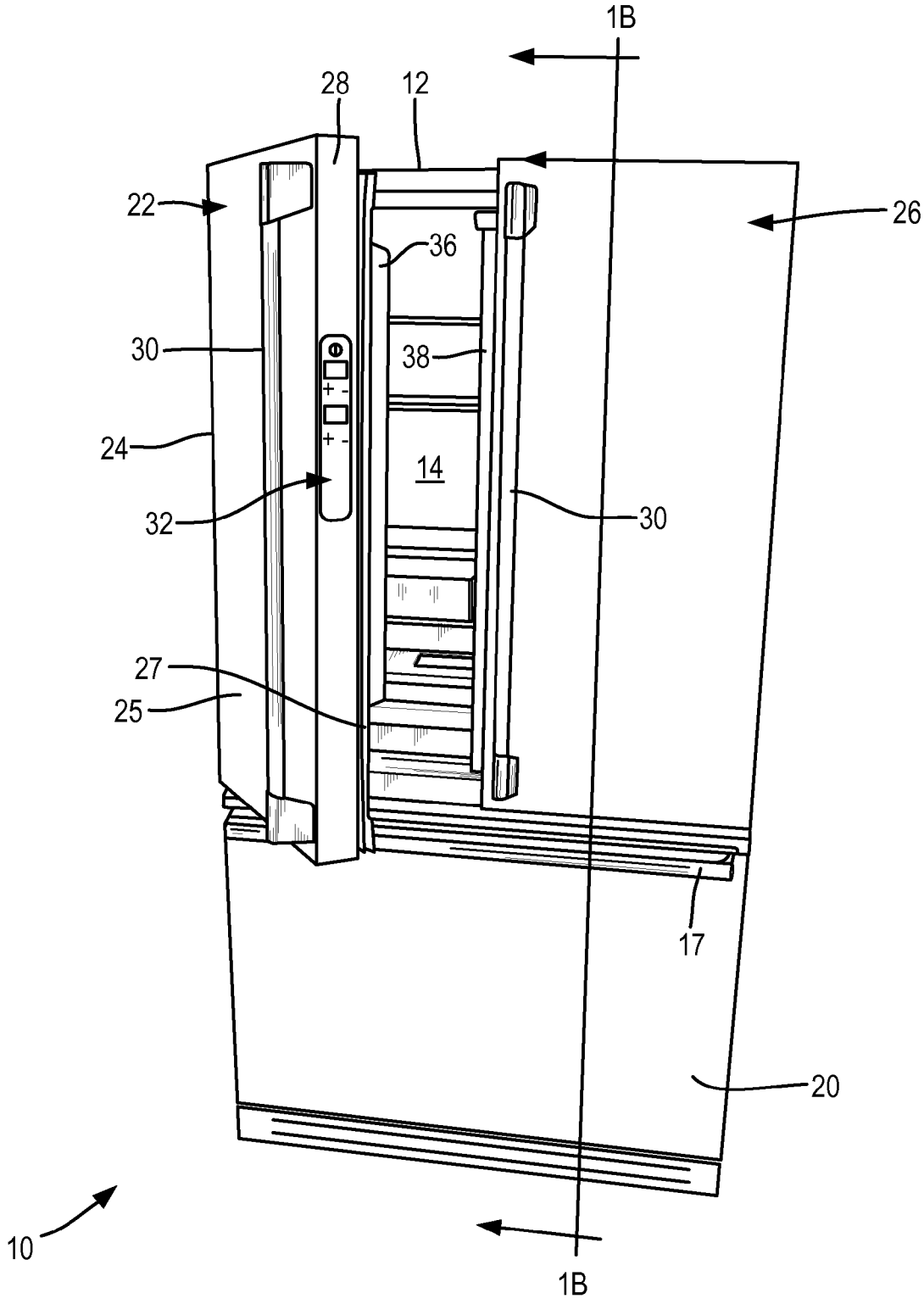
FIG. 1A is a front view of an illustrative embodiment of a refrigeration appliance comprising a user interface on a side portion of a door.

Certain terminology is used herein for convenience only and is not to be taken as a limitation on the present invention. Relative language used herein is best understood with reference to the drawings, in which like numerals are used to identify like or similar items. Further, in the drawings, certain features may be shown in somewhat schematic form.

It is also to be noted that the phrase "at least one of", if used herein, followed by a plurality of members herein means one of the members, or a combination of more than one of the members. For example, the phrase "at least one of a first widget and a second widget" means in the present application: the first widget, the second widget, or the first widget and the second widget. Likewise, "at least one of a first widget, a second widget and a third widget" means in the present application: the first widget, the second widget, the third widget, the first widget and the second widget, the first widget and the third widget, the second widget and the third widget, or the first widget and the second widget and the third widget.

FIG. 1A shows an illustrative embodiment of a refrigeration appliance 10. As shown the refrigeration appliance 10 includes a cabinet 12 defining a fresh-food compartment 14 for storing food items in a temperature-controlled environment having a fresh-food target temperature above 0° C. With reference to FIG. 1A and now also to FIG. 1B, the cabinet 12 also defines a freezer compartment 16 disposed at an elevation vertically beneath the fresh-food compartment 14 for storing food items in a temperature-controlled environment having a freezer target temperature that is less than 0° C. An automatic ice maker 15 can also optionally be disposed within the fresh-food compartment 14, and the ice formed by the ice maker 15 optionally exposed to the temperature within the fresh-food compartment 14. The temperatures and ranges provided are merely exemplary, and it is to be understood that other temperatures and ranges, including sub-ranges are also possible.

Figure 1B:
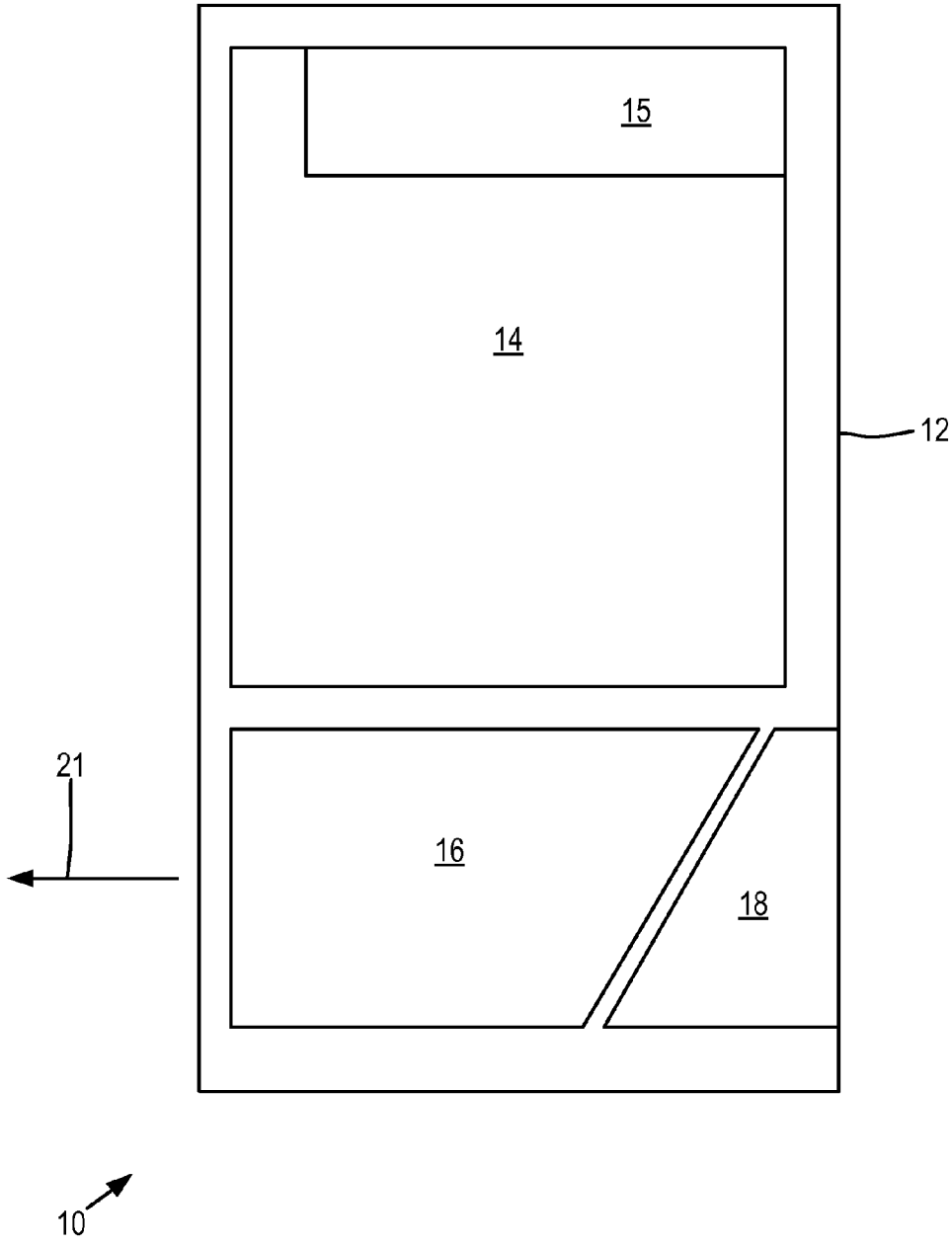
FIG. 1B is a schematic sectional view taken along line 1B-1B shown in FIG. 1.

The refrigeration appliance also includes a refrigeration system 18 shown schematically in FIG. 1B. The refrigeration system 18 is operable to provide a cooling effect to an interior of at least one of the fresh-food and freezer compartments 14, 16. The refrigeration system 18 can be any suitable cooling system employing a refrigerant that undergoes a phase change from liquid to gas in an evaporator as is known in the art to remove heat from air being introduced into at least one of the fresh-food and freezer compartments 14, 16. Generally, a compressor can be provided to the refrigeration system 18 to compress gaseous refrigerant to a high-temperature, high-pressure gas that is condensed and partially cooled to a warm liquid by a condenser. The warm liquid refrigerant is exposed to an interior of an evaporator assembly comprising many heat-transferring fins, in which the refrigerant rapidly expands and vaporizes into a gas. The phase change extracts the latent heat of vaporization from the ambient environment of the evaporator, thereby cooling air blown over the evaporator to be introduced into at least one of the fresh food and freezer compartments 14, 16 to provide the desired cooling effect. The gaseous refrigerant is returned to the compressor and the cycle repeated as necessary.

With continued reference to FIGS. 1A and 1B, a freezer drawer 20 is slidably supported within the freezer compartment 16 to store food items to be exposed to the sub-freezing temperatures and frozen within the freezer compartment 16. The freezer drawer 20 can be slideably extracted in the direction of arrow 21 (FIG. 1B) from the freezer compartment 16 to grant a user access to the contents stored therein. A substantially horizontal handle 17 extending across an exterior surface of a door provided to the freezer drawer 20 provides a surface that can be grasped to pull the freezer drawer 20 outwardly from within the freezer compartment 16.

To restrict access to a portion of the fresh food compartment 14, a first door 22 is pivotally connected adjacent to a first lateral side 24 to the cabinet 12. Likewise, a second door 26 is pivotally connected adjacent to a second lateral side 28 to the cabinet 12 with a hinge assembly to restrict access to another portion of the fresh-food compartment 14. The first and second doors 22, 26 are each insulated to minimize the escape of heat from the fresh food compartment 14, and thus, have a depth dimension that includes substantially-planar side portions 28 extending at least a part of the way between an exterior face 25 exposed to an ambient environment of the refrigeration appliance 10 and an interior portion 27 that is exposed to an interior of the fresh food compartment 14 while the doors 22, 26 are closed. The substantially-planar side portions 28 generally oppose each other when the first and second doors 22, 26 are in their closed positions. Planar faces of the side portions 28 can be substantially parallel to each other when the doors 22, 26 are in their closed positions. A handle 30 can be provided to each of the doors 22, 26, providing users with a surface to grasp when attempting to open the doors 22, 26.

To minimize the leakage of cool air from the fresh food compartment 14 between the doors 22, 26, cooperating mullion seal portions 36, 38 can optionally be provided to the first and second doors 22, 26 adjacent to the side portions 28. At least one of the mullion seal portions 36, 38 can be pivotally connected to the respective door 22, 26 to enable either of the doors 22, 26 to be closed before the other of the doors 22, 26. The other of the mullion seal portions 36, 38 can be a rubberized gasket that can contact the pivotally-connected of the mullion seal portions 36, 38 to form a seal. Thus, when the doors 22, 26 are closed the pivotal one of the mullion seal portions 36, 38 is rotated to expose a generally-planar surface to an exterior of the refrigeration appliance 10. The rubberized gasket mates with the substantially-planar surface to form a substantially airtight seal between the first and second doors 22, 26.

A user interface 32 can be at least partially recessed within the side portion 28 of at least one of the first and second doors 22, 26 (shown provided to the first door 22 in FIG. 1A) such that an exterior surface of the user interface 32 is substantially flush with the side portion 28 of the first door 22. When the first and second doors 14, 16 are in their closed positions the user interface 32 can be substantially hidden from view when the refrigeration appliance 10 is viewed from the front. By substantially hidden from view it is meant that the user interface 32 faces the side portion 28 of the other door 26, and does not have a noticeable outward appearance, thereby giving the refrigeration appliance 10 a clean look without requiring the user interface 32 to be disposed within the fresh food compartment 14 or freezer compartment 16.

Other embodiments include a user interface 32 that is not necessarily flush with the side portion 28, but is recessed into the side portion 28 and set back from the side portion 28. According to other embodiments, the user interface 32 can project outwardly from the side portion 28, but to a lesser extent than the distance separating the side portions of the first and second doors 22, 26, providing enough clearance to allow the first and second doors 22, 26 to swing closed without contacting each other.

Figure 2:
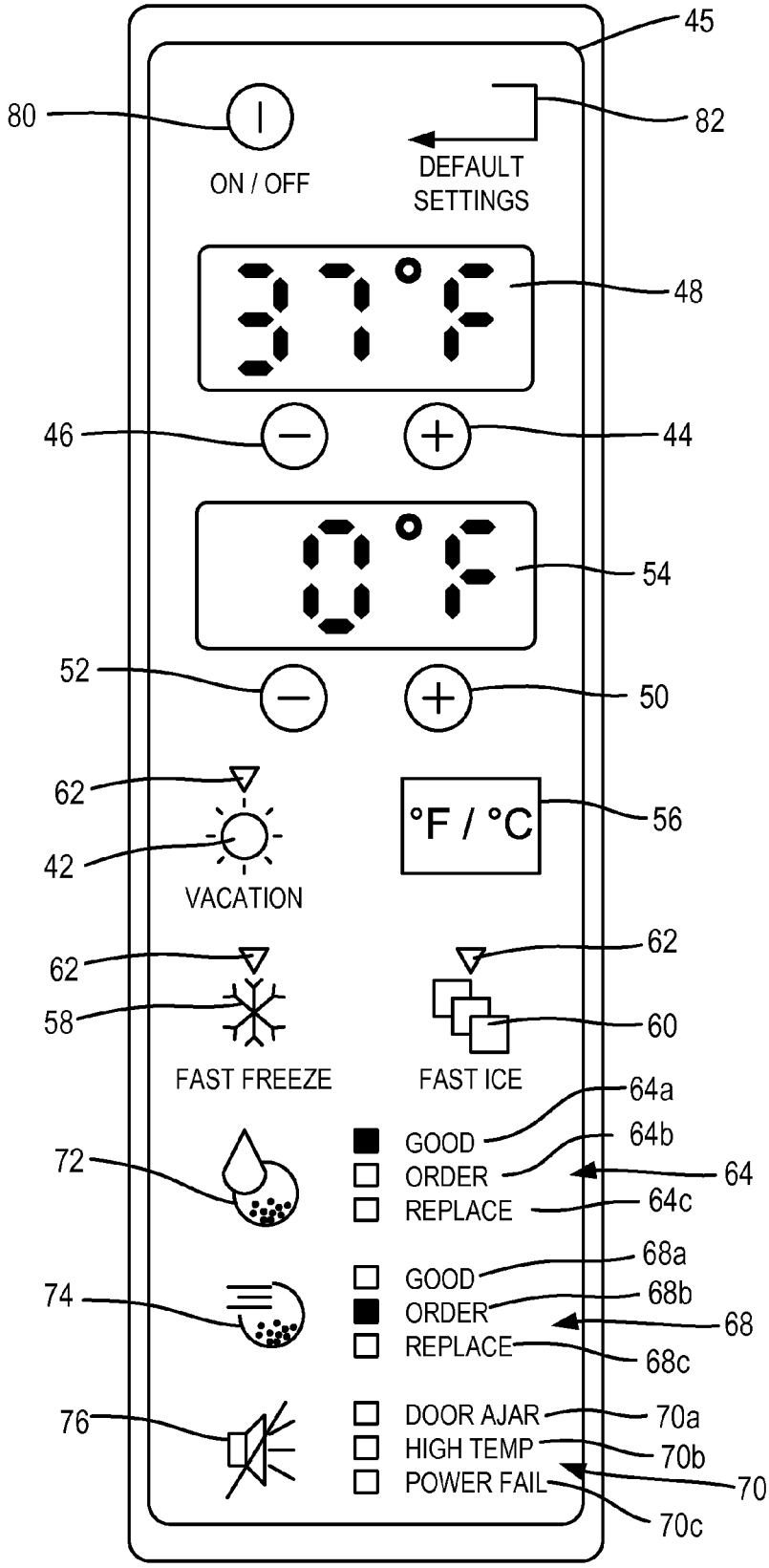
FIG. 2 is a view of a user interface to be provided to a side portion of a door restricting access to a temperature-controlled compartment of a refrigeration appliance.

An example of the user interface 32 is illustrated in FIG. 2. The user interface 32 shown in FIG. 2 includes a plurality of membrane switches, such as vacation membrane switch 42 for selecting a vacation mode discussed in detail below, covered by a decorative overlay 45 identifying a function of the various membrane switches provided. However, alternate embodiments can include any form of input device that can be manipulated by a user to input a selection to the refrigeration appliance 10 via the user interface 32. For example, other embodiments of the user interface 32 can include push buttons, computer-generated capacitive soft keys displayed by a LCD, OLED or other type of display; tactile buttons; multi-position switches; knobs; or any other input device that is operable to input a user selection to a controller instead of, or in addition to the membrane switches. However, for the sake of brevity and simplicity the user interface 32 will be described herein as utilizing membrane switches for the input devices.

The user interface 32 includes at least one membrane switch to be manipulated by a user for controlling a set temperature within at least one of the fresh-food and freezer compartments 14, 16. For the illustrative embodiment shown in FIG. 2, an "up" membrane switch 44 is provided to be pressed by the user for increasing the set temperature for the fresh food compartment 14 in one degree increments. Alternate embodiments allow for adjustment of target temperature in any desired increments, both smaller and larger than one degree. A "down" membrane switch 44 is also provided and can be pressed by the user for decreasing the set temperature for the fresh food compartment 14 in one degree increments for the present embodiment. The current target temperature for the fresh food compartment 14 can be displayed by a seven-segment display 48 or any other suitable display device provided adjacent to the up and down membrane switches 44, 46 for controlling the displayed temperature. Instead of the current target temperature, embodiments of the seven-segment display 48 can optionally display a sensed temperature within the fresh food compartment 14. Alternate embodiments of the seven-segment display 48 can optionally display a sensed temperature within the fresh food compartment 14 until a user pushes one of the up or down membrane switches 44, 46 to adjust the target temperature for the fresh food compartment 14, at which time the seven-segment display 48 can temporarily display the current target temperature for the fresh food compartment 14 before reverting back to the sensed temperature.

The embodiment illustrated in FIG. 2 also has a similar arrangement for the freezer compartment 16. An "up" membrane switch 50 is provided and can be pressed by the user for increasing the set temperature for the freezer compartment 16. A "down" membrane switch 52 is also provided and can be pressed by the user for decreasing the set temperature for the freezer compartment 16. The current set temperature for the freezer compartment 16 can also be displayed by a seven-segment display 54 or any other suitable display device provided adjacent to the up and down membrane switches 50, 52 for controlling the displayed temperature. Again, other embodiments of the user interface 32 can include display devices such as a LCD display, OLED display, or any suitable display other than the seven-segment displays 48, 54 shown in the illustrated example. And similar to the seven-segment display 48 discussed above, instead of the current target temperature, embodiments of the seven-segment display 54 can optionally display a sensed temperature within the freezer compartment 16. Alternate embodiments of the seven-segment display 54 can optionally display a sensed temperature within the freezer compartment 16 until a user pushes one of the up or down membrane switches 50, 52 to adjust the target temperature for the freezer compartment 16, at which time the seven-segment display 54 can temporarily display the current target temperature for the freezer compartment 16 before reverting back to the sensed temperature.

In addition to the membrane switches 44, 46, 50, 52 for controlling the set temperature of at least one of the fresh food and freezer compartments 14, 16, other membrane switches can also be provided to select an operational mode of the refrigeration appliance 10. For example, the vacation membrane switch 42 mentioned above can be pushed by the user to initiate a vacation mode of the refrigeration appliance 10. Occasionally, the evaporator of the refrigeration system 18 described above will accumulate frost and will require defrosting to ensure that the evaporator can provide an efficient cooling effect. However, much of the frost that accumulates on the evaporator is the result of moisture introduced into the interior of the refrigeration appliance 10 when one or both of the doors 22, 26 and the freezer drawer 20 are opened. When the user is on vacation these doors 22, 26 and the freezer drawer 20 will ostensibly not be opened in the user's absence. Thus, initiating the vacation mode by pressing the vacation membrane switch 42 sets the time between scheduled defrost cycles to its maximum value, thereby minimizing the number of energy-consuming defrost cycles that are performed, possibly unnecessarily.

A "units" membrane switch 56 can be pressed by the user to specify the units of measurement to be used for displaying the set temperature for the fresh food compartment 14, freezer compartment 16 or both. Each pressing of the units membrane switch 56 toggles the units of measurement between Fahrenheit and Celcius.

The illustrative user interface 32 shown in FIG. 2 also includes a "fast freeze" membrane switch 58 that can be selected to put the refrigeration appliance 10 in "fast freeze" mode. In fast freeze mode the set temperature within the freezer compartment 16, or a portion thereof, is lowered, possibly drastically lowered, to a predetermined set temperature pre-programmed into a controller of the refrigeration appliance. With the set temperature lowered, the refrigeration system 18 is activated in an attempt to quickly lower the actual temperature in the freezer compartment 16 (or portion thereof) to meet the pre-programmed set temperature. Thus, food items introduced to the freezer compartment 16 and subjected to the fast freeze mode can be quickly frozen in an attempt to preserve the fresh taste of the food items when unfrozen.

A "fast ice" membrane switch 60 can be provided to the user interface 32 to enable a user to initiate a "fast ice" mode. In the fast ice mode the automatic ice maker 15 provided to the refrigeration appliance 10 is operated in a manner that produces ice at a faster rate than when the fast ice mode is not active. For example, the ice maker operating in the fast ice mode can produce about 50% more ice than it produces when not in the fast ice mode.

One or more, or in the case of the illustrative embodiment shown in FIG. 2, all of the various mode membrane switches can be accompanied by an indicator 62 that signals to the user that one or more of the available operating modes of the refrigeration appliance 10 is active. The indicators 62 can be a window in the decorative overlay 45 that can be illuminated by a LED or other illumination device within the user interface 32. Any form of indicator 62 other than a LED-illuminated window that can convey the operational mode(s) of the refrigeration appliance 10 can be used in addition to, or in lieu of the LED illuminated window in the decorative overlay 45.

The user interface 32 in FIG. 2 also includes another status indicator indicating a status of at least one consumable product used by the refrigeration appliance 10. For the illustrative example shown, a water filter indicator 64 provides a user with an indication of whether a water filer of the refrigeration appliance 10 is ready to be replaced. The water filter can be provided to the refrigeration appliance 10 to minimize impurities in fresh water to be dispensed through a water dispenser provided to the refrigeration appliance 10, to minimize impurities in fresh water to be delivered to the automatic ice maker 15, or to minimize the impurities in fresh water used in any other manner by the refrigeration appliance. The water filter indicator 64 can include a "GOOD" status 64*a* that, if illuminated or otherwise active, signifies that the water filter is not near the end of its useful life. An "ORDER" status 64*b*, if illuminated or otherwise active, alerts the user when it is time to order a new water filter. The ORDER status 64*b* can forewarn the user of the upcoming need for a new water filter before the water filter has actually reached the end of its useful life and is to be replaced. The user can acquire a new water filter and have it available when the time to replace the existing water filter comes to avoid an interruption in the availability of filtered water. And finally, a "REPLACE" status 64*c* indicates that the existing water filter has reached the end of its useful life and should immediately be replaced. The statuses 64*a-c* can be based on a timer, reminding the user to change the water filter, for example, once at the end of a predetermined period of time. According to alternate embodiments, the statuses 64*a-c* can be based on a factor other than time.

Similar to water filter indicator 64, an air filter indicator 68 can be provided to the user interface 32 instead of, or in addition to the water filter indicator 64. An air filter can be disposed within the fresh-food compartment 14, freezer compartment 16, or both to minimize foul odors from food within the refrigeration appliance 10. The air filter indicator 68 shown in FIG. 2 also includes three different statuses 68*a-c* indicating whether the air filter provided to the refrigeration appliance 10 is in a "GOOD" condition, is nearing time for replacement or is at the end of its useful life. In FIG. 2, the water filter indicator 64 indicates that the status of the water filter is GOOD 64*a* and the air filter indicator 68 indicates that the status of the air filter is ORDER 68*b*.

The user interface 32 can optionally include a system status indicator 70 to inform the user of an operational state of the refrigeration appliance 10 and/or the refrigeration system 18. For instance, the embodiment of the system status indicator 70 shown in FIG. 2 informs the user whether the audible alert signals broadcast by the refrigeration appliance 10 in response to one or more sensed conditions are active. A door ajar indicator 70*a* can be illuminated to indicate that the door ajar alert signal is muted. In this condition the audible alert that would ordinarily sound in response to one or both of the doors 22, 26 and/or the freezer drawer 20 remaining open for a predetermined period will not be sounded. Likewise, a high temperature indicator 70*b* can inform the user that a high-temperature alert that is ordinarily sounded when the temperature in either or both of the fresh-food compartment 14 and the freezer compartment 16 has exceeded a threshold warm temperature has been muted. And a power failure indicator 70*c* can alert the user that the power failure alert sounded when the refrigeration appliance 10 loses electric power is muted.

Each of the water filter indicator 64 and the air filter indicator 68 can be independently reset to their GOOD statuses 64*a*, 68*a* if the user presses and holds the water filter membrane switch 72 and the air filter membrane switch 74, respectively, for a predetermined period of time. Thus, when the water filter and the air filter are replaced with new filters, their respective statuses can be reset to start the timer that is to remind the user as the new filters approach the end of their useful lives.

Similarly, a mute membrane switch 76 is also provided to allow the user to toggle through the various audible alerts that can be muted. Each push of the mute membrane switch 76 changes the audible alert that is muted and toggles through various, optionally all, available combinations. For the embodiment shown in FIG. 2 none of the available audible alerts are muted.

A power membrane switch 80 and a reset membrane switch 82 are provided to allow the user the ability to control the operation of the refrigeration appliance 10 as a whole. Pressing and holding the power membrane switch 80 for a predetermined period of time deactivates the refrigeration appliance 10, thereby preventing the refrigeration system 18 from providing the cooling effects described herein. Likewise, pressing and holding the reset membrane switch 82 for a predetermined period of time restores all settings of the refrigeration appliance such as the target temperature of the fresh-food compartment 14 and the freezer compartment 16, for example, to their factory-established values.

Figure 3:
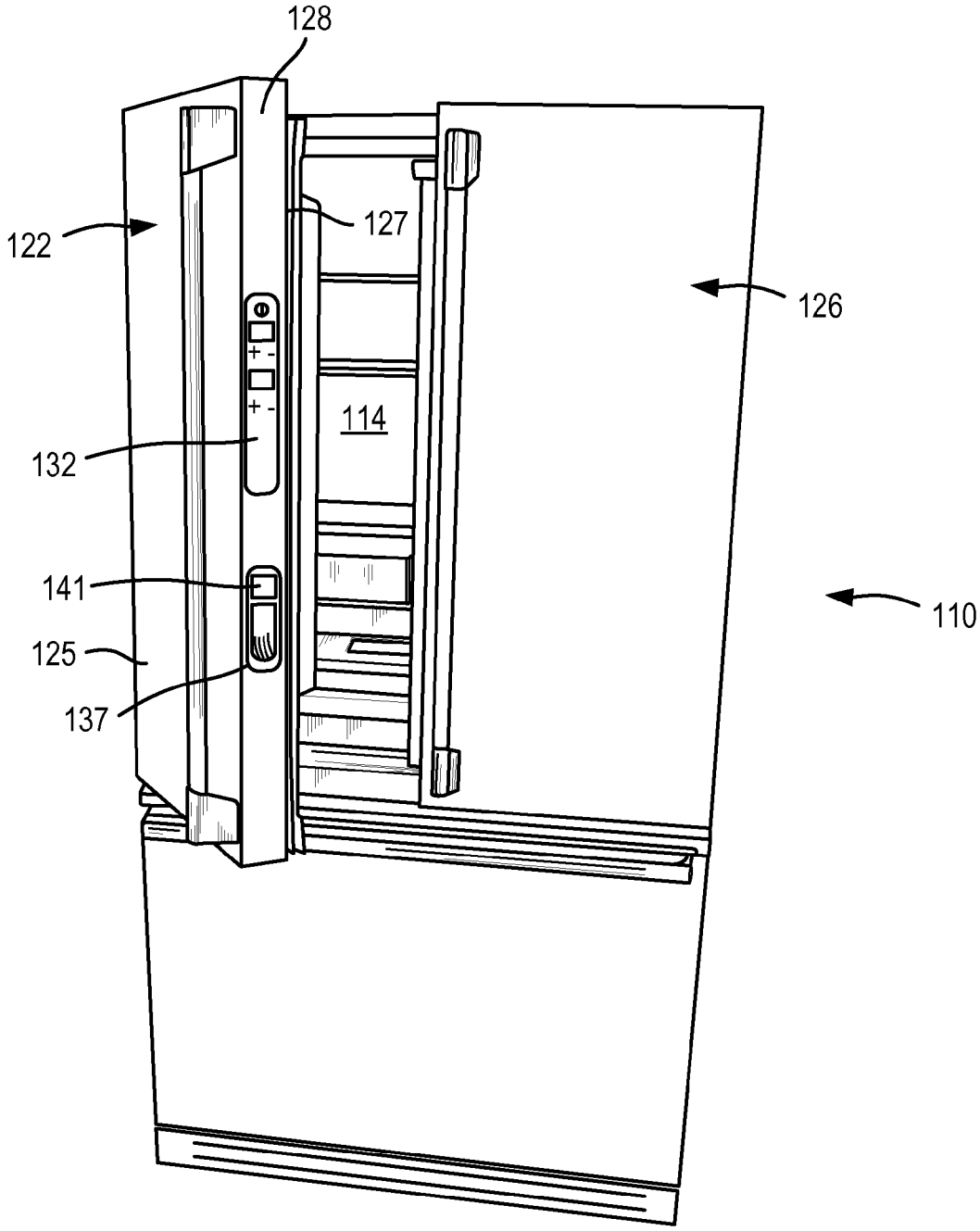
FIG. 3 is front view of an illustrative embodiment of a refrigeration appliance comprising a user interface and a dispenser on a side portion of a door.

FIG. 3 shows another illustrative embodiment of the refrigeration appliance 110. The refrigeration appliance 110 shown in FIG. 3 is once again configured as a so-called bottom-mount refrigerator, and includes first and second laterally-opposing French doors 122, 126 restricting access into a fresh-food compartment 114. Similar to the previous embodiments, the first and second doors 122, 126 are each insulated to minimize the escape of heat from the fresh-food compartment 114, and thus, have a depth dimension defined by substantially-planar side portions 128 extending at least a part of the way between an exterior face 125 exposed to an ambient environment of the refrigeration appliance 110 and an interior portion 127 that is exposed to an interior of the fresh food compartment 114 while the doors 122, 126 are closed. The substantially-planar side portions 128 generally oppose each other when the first and second doors 122, 126 are in their closed positions. Planar faces of the side portions 128 can be substantially parallel to each other when the doors 122, 126 are in their closed positions.

A user interface 132, such as user interface 32 shown in and described with reference to FIG. 2 can be provided to, and at least partially recessed within the side portion 128 of at least one of the first and second doors 122, 126 (shown provided to the first door 122 in FIG. 3) such that an exterior surface of the user interface 132 is substantially flush with the side portion 128 of the first door 122. When the first and second doors 122, 126 are in their closed positions the user interface 132 can be substantially hidden from view when the refrigeration appliance 110 is viewed from the front. Again, locating the user interface 132 on the side panel 128 allows the exterior face 125 of the first and second doors 126 to have a clean appearance, substantially free of obstructions such as control features, for example, that interrupt the substantially planar exterior face 125 of each of the first and second doors 122, 126.

In addition to, or instead of the user interface 132, the side portion 128 of the first or second doors 122, 126 (shown on the first door 122 along with the user interface 132 in the embodiment appearing in FIG. 3) can also include a dispenser 137. The dispenser can act as the outlet from a conduit 139, shown in broken lines in FIG. 4, through which ice can be transported between the automatic ice maker 15 (FIG. 1B) and the dispenser 137. A button 141 (FIG. 3), motion sensor, etc. . . . or other suitable input device can be provided in communication with an auger or other ice mover provided to the ice maker 15 to cause ice to be dispensed from the ice maker 15 and delivered through the dispenser 137 when the button 141 or other input device is manipulated. Ice from the ice maker 15 can drop under the force of gravity into the conduit 139 to fall from the dispenser 137 into a glass being held by the user adjacent to the side panel 128.

Communication between the button 141, for example, or other input device of the dispenser 137, can be established via a wire harness 145 that extends through the first door 122. The wire harness 145 can optionally extend between the first door 122 and the cabinet of the refrigeration appliance 110 to communicate with the ice maker 15 through a hollow hinge pin pivotally coupling the first door 122 to the cabinet. Other embodiments include simply extending the wire harness 145 in an exposed manner (i.e., externally of the first door 122 and cabinet and not through an interior passage such as that defined by a hollow hinge pin) between the first door 122 and the cabinet.

Likewise, communication between the user interface 132 and one or more control devices operable to control operation of the refrigeration system 18, for example, according to input entered via the user interface 132 can also be established by a wire harness 147. The wire harness 147 can extend between the first door 122 and the cabinet in any suitable manner, such as those described above for the wire harness 145.

Figure 4:
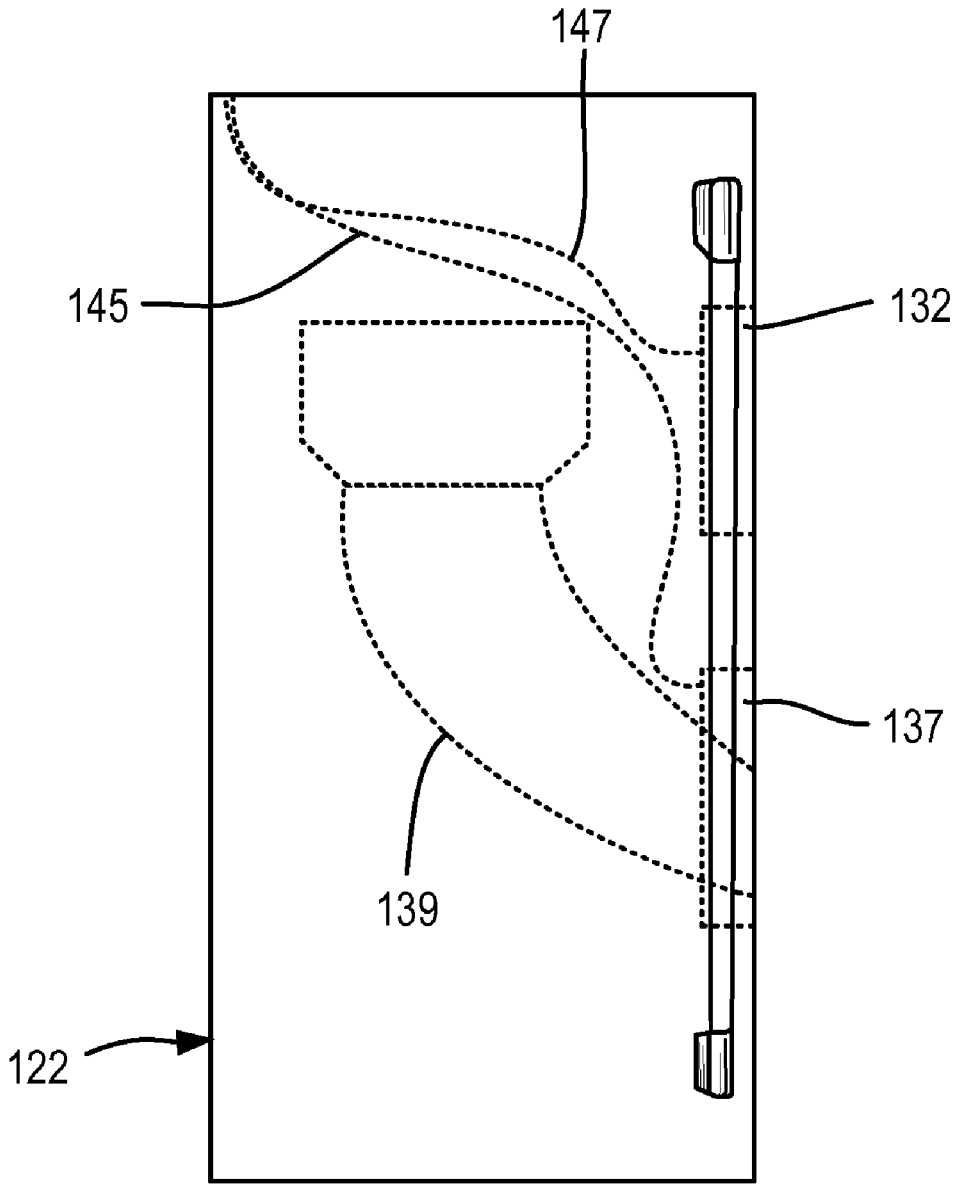
FIG. 4 is a front view of a door to be provided with a dispenser on a side portion thereof, wherein an ice chute formed in insulation provided to the door is shown in broken lines.

Although the embodiment shown in FIGS. 3 and 4 has been described as including a dispenser 137 that dispenses ice, alternate embodiments can include a dispenser that dispenses water filtered by a water filter provided to the refrigeration appliance 110, a dispenser that dispenses both filtered water and ice, a dispenser that dispenses any other item from the refrigeration appliance 110, or any combination thereof.

Illustrative embodiments have been described, hereinabove. It will be apparent to those skilled in the art that the above devices and methods may incorporate changes and modifications without departing from the general scope of this invention. It is intended to include all such modifications and alterations within the scope of the present invention.

What is claimed is:

1. A refrigeration appliance comprising:

a cabinet defining a fresh-food compartment for storing food items in a temperature-controlled environment having a fresh-food target temperature above 0° C. and a freezer compartment for storing food items in a temperature-controlled environment having a freezer target temperature that is less than or approximately equal to 0° C.;

a refrigeration system that is operable to provide a cooling effect to an interior of the fresh-food and freezer compartments;

a pair of doors pivotally connected to the cabinet with a hinge assembly for restricting access to the interior of the fresh-food compartment, wherein each door included in the pair of doors comprises:

an exterior face that is exposed to an ambient environment of the refrigeration appliance, an interior portion that is exposed to an interior of the compartment while the door is closed, and a side portion extending between the exterior face and the interior portion of the door, wherein the side portions of the doors generally oppose each other when the doors are closed;

a user interface provided to the side portion of at least one of the doors comprising an input device to be manipulated by a user for controlling a temperature within at least one of the fresh-food and freezer compartments; and a dispenser provided to the side portion of the door that is provided with the user interface, wherein the dispenser is operable to dispense water through the door.

2. The refrigeration appliance according to claim 1, wherein the user interface further comprises an additional input device to be manipulated by the user for controlling at least one of: an operational mode of the refrigeration appliance, temperature units used to express the temperature in at least one of the fresh-food and freezer compartments, an operational mode of an ice maker provided to the refrigeration appliance, main system power for the refrigeration appliance, and an audio setting for sounds broadcast by the refrigeration appliance.

3. The refrigeration appliance according to claim 1, wherein the user interface further comprises a display device provided to the user interface for displaying the temperature within at least one of the fresh-food and freezer compartments.

4. The refrigeration appliance according to claim 1, wherein the display device comprises a seven-segment LED display.

5. The refrigeration appliance according to claim 1 further comprising:

a control board disposed within the door that is provided with the user interface, the control board comprising electrical circuitry for receiving user input via the user interface and transmitting the user input via a communication channel to a main controller provided to the refrigeration appliance for controlling operation of the refrigeration system.

6. The refrigeration appliance according to claim 5, wherein the communication channel comprises at least one signal wire that extends adjacent to the hinge assembly between the door provided with the user interface and the cabinet.

7. The refrigeration appliance according to claim 1, wherein the user interface further comprises a status indicator indicating a remaining useful life of at least one of: a water filter and an air filter provided to the refrigeration appliance.

8. The refrigeration appliance according to claim 1, wherein the user interface further comprises a mute input device that can be selected by the user to mute all sounds broadcast by the refrigeration appliance to indicate a status of the refrigeration appliance.

9. The refrigeration appliance according to claim 1, wherein the freezer compartment is defined by the cabinet vertically beneath the fresh-food compartment and comprises a drawer that can be slideably inserted into and removed from the freezer compartment.

10. The refrigeration appliance according to claim 1, wherein the user interface is substantially hidden from view when the doors are closed.

11. The refrigeration appliance according to claim 1, wherein the exterior face of each of the doors is substantially planar and devoid of obstructions other than a handle to be grasped by the user to open and close the doors.

12. The refrigeration appliance according to claim 1, wherein the user interface is at least partially recessed into the side portion of the door to provide the user interface and side portion combination with a substantially planar appearance.

13. The refrigeration appliance according to claim 1, wherein the dispenser provided to the side portion of one of doors also dispenses ice through the door.

14. The refrigeration appliance according to claim 13, wherein the dispenser is provided to the exterior face of the door that is provided with the user interface.

15. The refrigeration appliance according to claim 1 further comprising a sensor for detecting when at least one of the doors is open and transmitting a signal indicating that the at least one door is open to illuminate a portion of the user interface.

16. The refrigeration appliance according to claim 15, wherein the portion of the user interface that is to be illuminated includes a display device that indicates a temperature within at least one of the fresh-food and freezer compartments.

17. A refrigeration appliance comprising:

a cabinet defining a fresh-food compartment for storing food items in a temperature-controlled environment having a fresh-food target temperature above 0° C.;

a freezer compartment disposed at an elevation vertically beneath the fresh-food compartment for storing food items in a temperature-controlled environment having a freezer target temperature that is less than or approximately equal to 0° C.;

a refrigeration system that is operable to provide a cooling effect to an interior of the fresh-food and freezer compartments;

a freezer drawer that can be slideably extracted from the freezer compartment to grant access to contents within the freezer drawer;

a first door pivotally connected adjacent to a first lateral side to the cabinet with a hinge assembly to restrict access to a portion of the fresh-food compartment;

a second door pivotally connected adjacent to a second lateral side to the cabinet with a hinge assembly to restrict access to another portion of the fresh-food compartment, the first and second doors each comprising substantially-planar side portions that comprise faces that oppose each other when the first and second doors are closed;

a user interface that is at least partially recessed within the side portion of at least one of the first and second doors, wherein the user interface is substantially flush with the side portion such that the user interface is substantially hidden from view when the doors are closed, the user interface comprising:

an input device to be manipulated by a user for controlling a temperature within at least one of the fresh-food and freezer compartments, a display device indicating a sensed temperature within the at least one of the fresh-food and freezer compartments, and a status indicator indicating a status of at least one of: a water filter provided to the refrigeration appliance, an air filter provided to the refrigeration appliance, and an operational state of the refrigeration system;

cooperating mullion seal portions provided to the first and second doors adjacent to the side portions that cooperate to form a seal between the first and second doors when the first and second doors are closed; and a dispenser provided to the side portion of the door that is provided with the user interface, wherein the dispenser is operable to dispense at least one of water and ice through the side portion.

18. The refrigeration appliance according to claim 17 further comprising a sensor for detecting when at least one of the doors is open and transmitting a signal indicating that the at least one door is open to illuminate the display device.

19. The refrigeration appliance according to claim 17, wherein each of the first and second doors comprises an exterior face that is substantially uniform, and devoid of apertures for mounting a dispenser or user interface on the exterior face.

* * * * *